United States Patent [19]

Dellinger et al.

[11] Patent Number: 4,577,701

[45] Date of Patent: Mar. 25, 1986

[54] SYSTEM OF DRILLING DEVIATED WELLBORES

[75] Inventors: Thomas B. Dellinger, Duncanville; Wilton Gravley, Farmers Branch, both of Tex.

[73] Assignee: Mobil Oil Corporation, New York, N.Y.

[21] Appl. No.: 638,915

[22] Filed: Aug. 8, 1984

[51] Int. Cl.[4] ..... E21B 7/04; E21B 7/08

[52] U.S. Cl. ..... 175/61; 175/73; 175/107

[58] Field of Search ..... 175/73, 75, 107, 61

[56] References Cited

U.S. PATENT DOCUMENTS

| | | | |
|---|---|---|---|
| 2,500,267 | 3/1950 | Zublin | 175/75 |
| 3,260,318 | 7/1966 | Neilson | 175/75 |
| 3,309,656 | 3/1967 | Godbey | 367/85 |
| 3,563,323 | 2/1971 | Edgecombe | 175/107 X |
| 3,667,556 | 6/1972 | Henderson | 175/107 X |
| 3,878,903 | 4/1975 | Cherrington | 175/73 X |
| 3,903,974 | 9/1975 | Cullen | 175/61 X |
| 4,067,404 | 1/1978 | Crase | 175/75 |
| 4,303,135 | 12/1981 | Benoit | 175/73 |
| 4,492,276 | 1/1985 | Kamp | 175/61 |

*Primary Examiner*—Stuart S. Levy
*Assistant Examiner*—Thomas R. Hannon
*Attorney, Agent, or Firm*—A. J. McKillop; Michael G. Gilman; George W. Hager, Jr.

[57] ABSTRACT

Directional drilling is carried out with a rotary drilling tool having a drill string, a drill bit, a drill motor for rotating the drill bit independently of the drill string, and a bent sub affixed between the lower end of the drill string and the drill motor for angularly displacing the axis of rotation of the drill bit from the axis of rotation of the drill string. Both the drill string and drill bit are rotated to provide a straight path for the wellbore, while only the drill bit is rotated during the deviation of the wellbore from a straight path.

4 Claims, 3 Drawing Figures

SYSTEM OF DRILLING DEVIATED WELLBORES

BACKGROUND OF THE INVENTION

The present invention relates to rotary drilling and, more particularly, to a directional drilling technique for providing deviated wellbores at significantly greater inclinations and/or over horizontal distances substantially greater than that currently being achieved by conventional directional drilling practices. The success of such directional drilling should benefit mainly offshore drilling projects as platform costs are a major factor in most offshore production operations. Wellbores with large inclination or horizontal distance offer significant potential for (1) developing offshore reservoirs not otherwise considered to be economical, (2) tapping sections of reservoirs presently considered beyond economical or technological reach, (3) accelerating production by longer intervals in the producing formation due to the high angle holes, (4) requiring fewer platforms to develop large reservoirs, (5) providing an alternative for some subsea completions, and (6) drilling under shipping fairways or to other areas presently unreachable.

A number of problems are presented by high angle directional drilling. In greater particularity, hole inclinations of 60° or greater, combined with long sections of hole or complex wellbore profiles present significant problems which need to be overcome. The force of gravity, coefficients of friction, and mud particle settling are the major physical phenomena of concern.

As inclination increases, the available weight from gravity to move the pipe or wireline string down the hole decreases as the cosine of the inclination angle, and the weight lying against the low side of the hole increases as the sine of the inclination angle. The force resisting the movement of the drill string is the product of the apparent coefficient of friction and the sum of the forces pressing the string against the wall. At an apparent coefficient of friction of approximately 0.58 for a common water base mud, drill strings tend to slide into the hole at inclination angles up to approximately 60°. At higher inclination angles, the drill strings will not lower from the force of gravity alone, and must be mechanically pushed or pulled, or alternatively, the coefficients of friction can be reduced.

In each of U.S. Pat. Nos. 2,500,267 to Zublin; 3,260,318 to Neilson, et al.; and 3,667,556 to Henderson, there is described rotary drilling apparatus in which a drill string is rotated to turn a downhole drill bit during conventional drilling operations and in which the drill string is held stationary while the drill bit is rotated about an axis inclined from that of the drill string during the deviating of the direction of the wellbore.

SUMMARY OF THE INVENTION

In accordance with the present invention, there is provided a method and system for directional drilling in which a deviated wellbore is drilled with a rotary drilling tool wherein a drill string is used to advance a drill bit through the earth and a drilling fluid is circulated down the drill string and returned from the wellbore in the annulus formed about the drill string.

More particularly, a vertical first portion of the wellbore is drilled into the earth from a surface location to a kick-off point at about the lower end of such first portion by rotating and advancing a drill string and drill bit into the earth. A deviated second portion of the wellbore is initiated at the kick-off point. A specialized drill tool for drilling the deviated second portion of the wellbore is run into the vertical first portion of the wellbore. Such tool includes a drill string, a drill bit, a motor for rotating the drill bit, and means for angularly directing the drill bit relative to the axial direction of the drill string. The deviated second portion is drilled, firstly, by rotating the drill bit with the drill motor and simultaneously, but independently, rotating the drill string whenever the deviated portion is to be in a straight path, and secondly, by terminating the rotation of the drill string, selecting the orientation of the angular direction of the drill bit with respect to the drill string for changing the direction of the deviated portion in a desired direction from a straight path, and thereafter rotating only the drill bit with the drill motor so as to effect the desired change in direction from the straight path. The means for angularly directing the axis of rotation of the drill bit may be a bent sub, bent housing for the drill motor, or eccentric stabilizers or an offset drive shaft of the drill motor. The selection of the orientation of the angular direction of the drill bit axis is in response to a measuring-while-drilling system located at the lower end of the drill string near the drill bit.

In a further aspect, when both the drill string and drill bit are rotated, the drill string is rotated at a slower speed than the drill bit which is at least sufficient to maintain a straight path for the drilling of the deviated portion of the wellbore. The drill bit axis of rotation is directed at an angle sufficient to provide an offset from the axial direction of the drill string for a wellbore of a desired diameter.

DESCRIPTION OF THE PREFERRED EMBODIMENT

This invention is directed to a rotary drilling technique for drilling a deviated wellbore into the earth. In rotary drilling operations, a drill string is employed which is comprised of drill pipe, drill collars, and a drill bit. The drill pipe is made up of a series of joints of seamless pipe interconnected by connectors known as tool joints. The drill pipe serves to transmit rotary torque and drilling mud from a drilling rig to the bit and to form a tensile member to pull the drill string from the wellbore. In normal operations, a drill pipe is always in tension during drilling operations. Drill pipe commonly varies from 3½" to 5" in outside diameter. Drill collars are thick-walled pipe as compared to drill pipe and thus are heavier per linear foot than drill pipe. The drill collars act as stiff members of the drill string. The drill collars are normally installed in the drill string immediately above the bit and serve to supply weight on the bit.

In carrying out rotary drilling techniques, a drilling rig is employed which utilizes a rotary table for applying torque to the top of the drill string to rotate the drill pipe and the drill bit. The rotary drill table also acts as a base stand on which all tubulars, such as drill pipe, drill collars, and casing, are suspended in the hole from the rig floor. A kelly is used as a top tubular member in the drill string and the kelly passes through the rotary table and is acted upon by the rotary table to apply the torque through the drill pipe to the drill bit. Mud pumps are used for circulating drilling fluid or mud intermediate the drilling rig and the bottom of the wellbore. Normally, the drilling fluid is pumped down the drill pipe and out through the drill bit and is returned to the surface through the annulus formed about the drill pipe. The drilling fluid serves such purposes as removing earth cuttings made by the drill bit from the wellbore, cooling the bit, and lubricating the drill pipe to lessen the energy required in rotation. In completing the well, casing is normally run thereinto and is cemented for the purpose of sealing and maintaining the casing in place.

In the drilling of a deviated wellbore, there may preferably be drilled a vertical first portion of the wellbore into the earth's crust from a surface location to a kick-off point at about the lower end of the first portion by rotating and advancing a drill string and drill bit into the earth's crust. A deviated second portion of the wellbore is initiated at the kick-off point.

Figure 1:
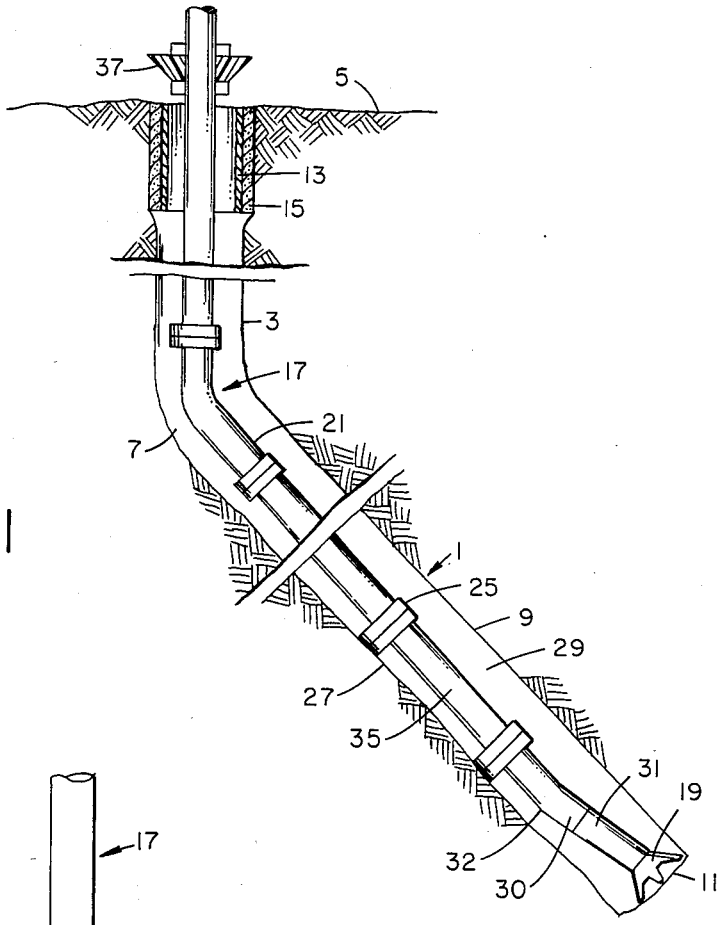
FIG. 1 is a schematic drawing of a deviated wellbore extending into the earth and illustrates one embodiment of a rotary drilling tool utilized in the present invention.

The use of the present invention in the drilling of a deviated wellbore will now be described in conjunction with reference to the drawings. With reference to FIG. 1, there is shown a wellbore 1 having a vertical first portion 3 that extends from the surface 5 of the earth to a kick-off point 7 and a deviated second portion 9 of the wellbore which extends from the kick-off point 7 to the wellbore bottom 11. A shallow or surface casing string 13 is shown in the wellbore surrounded by a cement sheath 15. A drill string 17, having a drill bit 19 at the lower end thereof, is shown in the wellbore 1. The drill string 17 is comprised of drill pipe 21 and the drill bit 19, and will normally include drill collars (not shown). The drill pipe 21 is comprised of joints of pipe that are interconnected together by either conventional or eccentric tool joints 25, as is also illustrated in U.S. Pat. No. 4,246,975, in the vertical first portion 3 of the wellbore extending in the open hole portion thereof below the casing 13 as well as in the deviated second portion 9 of the wellbore. The tool joints 25 in the deviated second portion 9 of the wellbore rest on the lower side 27 of the wellbore and support the drill pipe 21 above the lower side 27 of the wellbore.

In drilling of the wellbore, drilling fluid (not shown) is circulated down the drill string 17, out of the drill bit 19, and returned via the annulus 29 of the wellbore to the surface 5 of the earth. Drill cuttings formed by the breaking of the earth by the drill bit 19 are carried by the returning drilling fluid in the annulus 29 to the surface of the earth. These drill cuttings (not shown) tend to settle along the lower side 27 of the wellbore about the drill pipe 21. The eccentric tool joints 25 resting on the lower side 27 of the wellbore support the drill pipe 21 above most of these cuttings. During drilling operations, the drill string 17 is rotated and the rotation of the eccentric tool joints 25 causes the drill pipe 21 to be eccentrically moved in the wellbore. This movement of the drill pipe 21 tends to sweep the drill cuttings (not shown) from the lower side of the wellbore 27 into the main stream of flow of the returning drilling fluid in the annulus 29, and in particular into that part of the annulus which lies around the upper side of the drill pipe 21, where they are better carried by the returning drilling fluid to the surface of the earth.

Located at the lower end of the drill string 21 is the bent sub 30, drill motor 31 and drill bit 19. Drill bit 19 is rotated by drill motor 31 independently of any rotation of the drill string 17. The bent sub 30 is a section of the drill string that is bent or deviated at 32 from the axis of the drill string. In this way, the axis of rotation of the drill bit 19 is angularly displaced from the axis of the rotation of the drill string. Located immediately above bent sub 30 is the measuring-while-drilling system 35. Rotation of both the drill string 17 by the surface located kelly 37 and the drill bit 19 by the drill motor 31 effects a generally straight path for the second deviated portion 9 of the wellbore. The direction of this second deviated portion 9 is measured and a signal identifying this direction sent uphole to the surface. To change this direction, the rotation of drill string 21 is stopped, the orientation of the bent sub 30 is set to redirect the drill bit 19 in the desired change of direction, and the rotation of the drill bit 19 continued through only the drill motor 31. This effects a change in the direction of the wellbore from the straight path. When the desired directional change has been completed, as indicated by the measuring-while-drilling system, the rotation of the drill string 21 is restarted.

Figure 2:
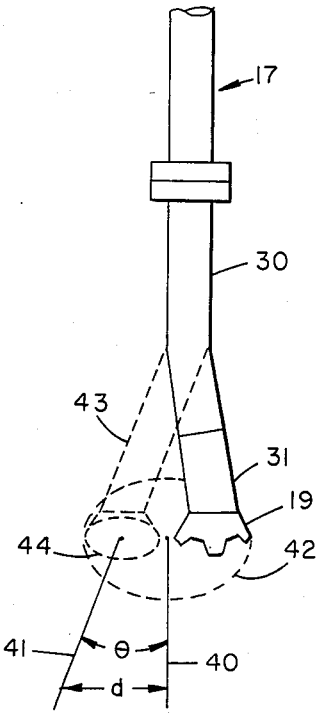
FIG. 2 is a diagrammatic drawing illustrating the drilling pattern of the rotary drilling tool of FIG. 1.

FIG. 2 illustrates diagrammatically such a change in direction of the second deviated portion 9 of the wellbore. When both the drill string 17 and drill bit 19 are rotated, the borehole follows the direction of the straight path 40 with the borehole size being shown by the dashed lines 42. Preferably, the drill string is rotated at relatively slow speed sufficient to both maintain a straight path and to minimize friction loss from dragging of the drill string along the lower side of the wellbore. Such rotational speed may be in the range of 10 to 25 revolutions per minute, for example. However, slower or faster speeds may also be sufficient. During a change in direction with the bent sub oriented as indicated by the dashed lines 43, the drilling follows the path 41 with the initial borehole size as shown by the dashed lines 44. Following such direction change, the drill string 17 is again rotated and the borehole of the size shown by dashed lines 42 continues in the new direction 41.

An alternative to the use of the bent sub 30 for angularly displacing the axis of rotation of the drill bit 19 from that of the drill string is the use of a bent housing for the drill motor 31. A further alternative is the offsetting of the axis of the drive shaft of the drill motor 31. Another alternative is the use of non-concentric stabilizers on the drill motor 31.

Figure 3:
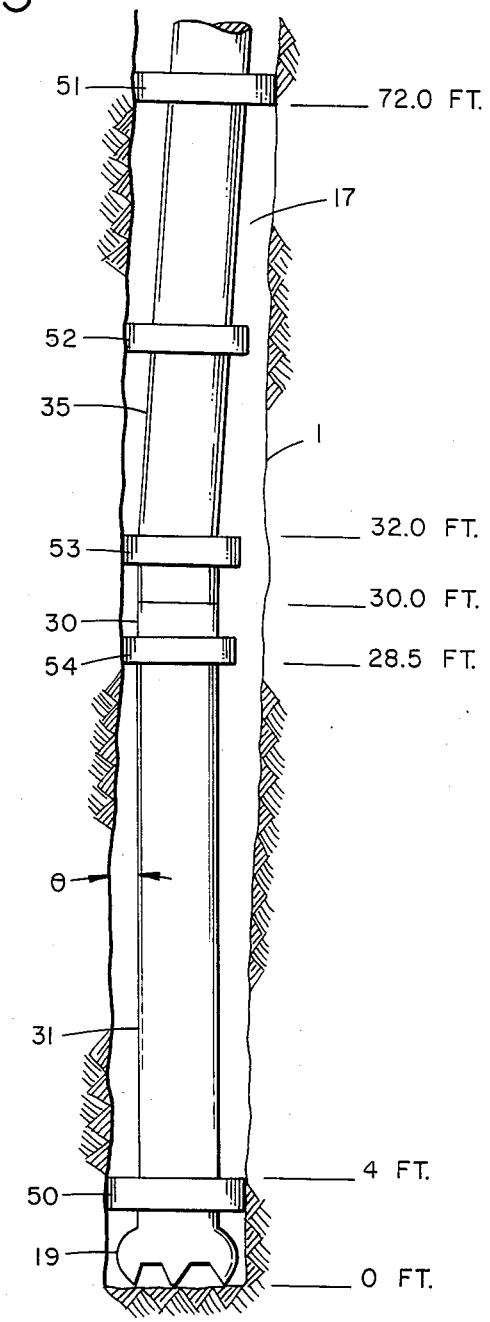
FIG. 3 is a more detailed schematic drawing of the rotary drilling tool of FIG. 1.

In high-angle directional drilling, especially for inclinations greater than 60° from the vertical, maintaining the direction and inclination of the wellbore is a difficult, costly, and time-consuming effort. Precision in maintaining close control of high-angle inclination is, therefore, quite important. An increase in only two degrees from an inclination of 80° to 82°, for example, with a 0.1 effective coefficient of friction, can decrease the available bit weight from a drill collar by one-half (from a factor of 0.075 to 0.040). Such control can generally be maintained by a drilling deviation of 1° or less. In one embodiment, as shown in FIG. 3, the bent sub 30 provides a deviation angle $\theta$ of 174° from the vertical axis of the drill string 17 and is in the order of $3\frac{1}{2}$ feet in length. Drill bit 19 is a $12\frac{1}{4}$ inch bit. Drill motor 31 is $7\frac{3}{4}$ inch Delta 1000 mud motor supplied by Dyna-Drill Co. of Irvine, Calif., and which is $24\frac{1}{2}$ feet in length. The measuring-while-drilling system 35 can be of the types supplied by The Analyst/Schlumberger of Houston, Tex.; Gearhart Industries of Fort Worth, Tex.; Teleco Oil Field Services of Meriden, Conn.; or Exploration Logging of Sacramento, Calif. Other suitable measuring-while-drilling systems are disclosed in U.S. Pat. Nos. 3,309,656; 3,739,331; 3,770,006; and 3,789,355. Stabilizers 50 and 51 are full gauge stabilizers. Stabilizer 52 is of $10\frac{3}{4}$ inch diameter and stabilizers 53 and 54 are $9\frac{1}{4}$ inch diameter. With a distance of about 30 feet from the bottom of the wellbore to the deviating point of the bent sub 30 and an angle of deviation $\theta$ of $\frac{1}{4}°$, a drilling offset of about $1\frac{1}{2}$ inches is provided from the center line of the wellbore as shown in FIG. 2. Other angles of deviation may be selected to provide varying drilling offsets. Suitable angles are from about $\frac{1}{8}°$ to about $\frac{1}{2}°$ at distances of 30 ft. to 10 ft. to the deviating point of the bent sub 30.

Whatever the selections for deviation angle $\theta$, component lengths, and drilling offset, it is important that a continuous lateral penetration of the drill bit into the sidewall of the wellbore be maintained during the change of drilling direction. If such penetration is not maintained with the bent sub lying on the low side of the wellbore, the bent sub would have to be raised by means of stabilizer blades or a wedge or by means of a larger angle bent sub in order to obtain a positive penetration factor.

While a preferred embodiment of the invention has been described and illustrated, numerous modifications or alterations may be made without departing from the spirit and scope of the invention as set forth in the appended claims.

We claim:

1. A system for the rotary drilling of a deviated wellbore into the earth, comprising (a) a drill string, (b) a drill bit, (c) a drill motor for rotating said drill bit independently of rotation of said drill string, (d) a bent sub affixing said drill motor to the lower end of said drill string for directing the axis of rotation of said drill bit such that it is angularly displaced from the axis of said drill string, (e) a measuring-while-drilling system for providing an indication of the directivity of said wellbore, (f) means responsive to said measuring-while-drilling system for rotating said drill string along with the independent rotation of said drill bit for effecting a straight path for said wellbore, and (g) means responsive to said measuring-while-drilling system for stopping the rotation of said drill string and maintaining only rotation of said drill bit for effecting a change in the direction of the wellbore from said straight path.

2. The system of claim 1 wherein said bent sub inclines the rotational axis of said drill bit to produce a continuous lateral penetration of the drill bit into the sidewall of the wellbore during the change of drilling direction.

3. The system of claim 1 wherein said bent sub directs the axis of said drill bit at an angle of no greater than 1 degree from the axis of said drill string.

4. The system of claim 1 wherein said wellbore is inclined at least 60 degrees from the vertical and said drill bit produces a continuous lateral penetration into the sidewall of the wellbore during the change of drilling direction with the bent sub lying on the lower side of the inclined wellbore.

* * * * *